US008280064B2

(12) United States Patent
Prather et al.

(10) Patent No.: US 8,280,064 B2
(45) **Date of Patent: *Oct. 2, 2012**

(54) RADIO FREQUENCY INTERFERENCE REDUCTION IN CONNECTION WITH MOBILE PHONES

(75) Inventors: Scott D. Prather, Seattle, WA (US); Herman Chien, Redmond, WA (US); Michael E. Prise, Kirkland, WA (US)

(73) Assignee: AT&T Mobility II LLC, Atlanta, GA (US)

( * ) Notice: Subject to any disclaimer, the term of this patent is extended or adjusted under 35 U.S.C. 154(b) by 23 days.

This patent is subject to a terminal disclaimer.

(21) Appl. No.: 12/817,745

(22) Filed: Jun. 17, 2010

(65) Prior Publication Data

US 2010/0255832 A1 Oct. 7, 2010

Related U.S. Application Data

(63) Continuation of application No. 11/459,041, filed on Jul. 21, 2006, now Pat. No. 7,764,798.

(51) Int. Cl.
*H04R 29/00* (2006.01)

(52) U.S. Cl. ..... 381/60; 381/23.1; 381/312; 381/317

(58) Field of Classification Search ..... 455/41.2, 455/41.3, 67.11, 515; 381/60, 23.1, 312–321; 379/52; 600/559; 73/585
See application file for complete search history.

(56) References Cited

U.S. PATENT DOCUMENTS 5,233,665 A 8/1993 Vaughn et al.
5,325,436 A 6/1994 Soli et al.
5,491,747 A 2/1996 Bartlett et al.
5,842,115 A * 11/1998 Dent ..... 455/73
5,956,330 A * 9/1999 Kerns ..... 370/336
6,032,033 A * 2/2000 Morris et al. ..... 455/277.2
6,035,050 A 3/2000 Weinfurtner et al.
6,418,227 B1 7/2002 Kuo
6,438,670 B1 * 8/2002 McClannahan ..... 711/167
6,445,799 B1 * 9/2002 Taenzer et al. ..... 381/71.6
6,654,467 B1 11/2003 York et al.
6,704,422 B1 3/2004 Jensen
6,785,394 B1 8/2004 Olsen et al.
6,978,010 B1 12/2005 Short et al.
7,031,460 B1 4/2006 Zheng et al.
7,058,185 B1 6/2006 Egelmeers et al.
7,092,532 B2 8/2006 Luo et al.
7,106,845 B1 * 9/2006 Zhuk et al. ..... 379/207.11
7,292,699 B2 11/2007 Gao et al.
7,346,175 B2 3/2008 Hui et al.
7,349,549 B2 * 3/2008 Bachler et al. ..... 381/314
7,463,745 B2 12/2008 Miller, III
7,519,186 B2 4/2009 Varma et al.
7,855,727 B2 * 12/2010 Adler et al. ..... 348/65

(Continued)

OTHER PUBLICATIONS

OA dated May 29, 2009 for U.S. Appl. No. 11/459,041, 34 pages.

*Primary Examiner* — Dominic E Rego

(74) *Attorney, Agent, or Firm* — Turocy & Watson, LLP

(57) ABSTRACT

A wireless communications apparatus comprises a monitor component that analyzes transmitter operating parameters of the wireless communications apparatus. A generator component generates an acoustic anti-phase burst based at least in part upon the analyzed transmitter operating parameters, wherein the acoustic anti-phase burst reduces effects of radio frequency interference received at a hearing aid.

20 Claims, 11 Drawing Sheets

U.S. PATENT DOCUMENTS

2002/0013881 A1* 1/2002 Delp et al. ..... 711/105
2003/0040345 A1 2/2003 Berger et al.
2003/0045283 A1 3/2003 Hagedoorn
2003/0059073 A1* 3/2003 Bren et al. ..... 381/312
2004/0161063 A1* 8/2004 Stewart et al. ..... 375/346
2004/0172102 A1* 9/2004 Leysieffer ..... 607/57
2004/0252855 A1* 12/2004 Vasserman et al. ..... 381/331
2005/0153727 A1 7/2005 Li
2005/0227665 A1 10/2005 Murray et al.
2005/0255843 A1 11/2005 Hilpisch et al.
2006/0009156 A1 1/2006 Hayes et al.
2006/0018497 A1* 1/2006 Kornagel ..... 381/315
2006/0029212 A1 2/2006 Short et al.
2006/0153343 A1* 7/2006 Yamazaki et al. ..... 379/52
2006/0182294 A1* 8/2006 Grasbon et al. ..... 381/312
2006/0210103 A1* 9/2006 Van den Heuvel ..... 381/315
2006/0217064 A1* 9/2006 Glass et al. ..... 455/41.1
2006/0259080 A1* 11/2006 Vaisnys et al. ..... 607/5
2006/0271118 A1* 11/2006 Libbus et al. ..... 607/9
2007/0032271 A1 2/2007 Chan et al.
2007/0053522 A1 3/2007 Murray et al.
2007/0066228 A1 3/2007 Leinonen et al.
2007/0078540 A1* 4/2007 Bump et al. ..... 700/90
2007/0248055 A1* 10/2007 Jain et al. ..... 370/331
2007/0248237 A1 10/2007 Bren et al.
2008/0058035 A1 3/2008 Pilsila et al.
2009/0006584 A1* 1/2009 Gregoire et al. ..... 709/220

* cited by examiner

RADIO FREQUENCY INTERFERENCE REDUCTION IN CONNECTION WITH MOBILE PHONES

CROSS REFERENCE TO RELATED APPLICATIONS

This application is a continuation of U.S. patent application Ser. No. 11/459,041, filed on Jul. 21, 2006, entitled RADIO FREQUENCY INTERFERENCE REDUCTION IN CONNECTION WITH MOBILE PHONES, the entirety of which is incorporated herein by reference.

BACKGROUND

The mobile telephone industry has been associated with tremendous growth over the last several years. For instance, in the recent past, mobile telephones were only available to those of highest economic status due to service costs and costs associated with mobile phones. Moreover, network coverage was not extensive enough to enable robust service. In particular, only areas associated with dense population were provided with extensive wireless network coverage. Still further, the mobile phones that could utilize the networks to communicate were quite bulky, causing portation of the phone over any significant distance to be difficult at best. In more detail, antennas associated with these phones could be over a foot in length, thus making it difficult to utilize the phones in automobiles or other similar areas.

In contrast, today's portable phones (and other portable devices) can be utilized as full-service computing machines. For example, many of the most recent and advanced mobile phones can be associated with word processing software, accounting software, and various other types of software. Furthermore, network coverage has expanded to cover millions, if not billions, of users. Additionally, mobile phones have decreased in both size and cost. Specifically, modern mobile phones are often small enough to slip into an individual's pocket without discomforting the individual. Furthermore, many mobile network service providers offer phones at extremely low cost to customers who contract for service with such providers.

As portable phones are continuously associated with increased affordability, more and more individuals across various demographics are becoming users of portable phones. For instance, due to a desire to quickly and conveniently locate their children, many parents are providing such children with portable telephones. Similarly, an increasing number of individuals of advancing age are purchasing and using cellular telephones. As a consequence, an increasing number of people who use hearing aids to increase their quality of life are using cellular telephones or are desiring to use cellular telephones.

Conventionally, however, use of portable telephones by those who utilize hearing aids has been difficult due to detrimental effects of radio frequency (RF) interference on hearing aids, wherein the RF interference is associated with mobile telephones. In more detail, mobile telephones emit RF signals in order to facilitate communications in its serving network. The radiated RF signals have the potential to be demodulated by various non-linear devices (such as hearing aids) that are near the antenna of the mobile telephone. Hearing aid users may notice that some mobile telephones cause audible interference that can compromise intelligibility of speech received through the mobile telephone. The severity of the interference is influenced by a number of factors, such as the antenna design of the mobile telephone, transmitter output power, arlink type and device form factor. For instance, in a Global System for Mobile Communications (GSM) device, demodulated RF signal bursts can be audible as a low-frequency "buzz", which, in some instances, can completely render speech incomprehensible.

One manner for reducing affects of RF interference with respect to hearing aids is to alter radiation characteristics of a mobile telephone, such that as little power as possible is provided to an earpiece of the phone. This can be accomplished through modifying the antenna, for example. Changes of this type, however, can cause a reduction of network coverage with respect to the mobile telephone, resulting in an increasing number of dropped calls. Additionally, changes made to an antenna can result in undesirable changes to a shape, size, and weight of a mobile telephone.

SUMMARY

The following presents a simplified summary in order to provide a basic understanding of some aspects of the claimed subject matter. This summary is not an extensive overview, and it is not intended to identify key/critical elements of the claimed subject matter or to delineate the scope thereof. Its sole purpose is to present some concepts in a simplified form as a prelude to the more detailed description that is presented later.

The claimed subject matter is directed generally towards enhancing user satisfaction with mobile telephones, and particularly towards reducing unwanted noise perceived by users of hearing aids, wherein such noise is caused by radio frequency (RF) interference radiated from mobile telephones. As described above, today's hearing aids can detect and demodulate such RF interference, often resulting in a "buzzing" noise provided to a hearing aid user that is employing a mobile telephone to effectuate wireless communications. To reduce an amount of such noise perceived by a user, a mobile telephone can be configured to analyze transmitter operating parameters and generate an acoustic burst (that is out of phase with the RF interference) based at least in part upon such parameters. Thus, audible RF interference will be reduced.

It is understood, however, that different hearing aids can be associated with unique characteristics, such as microphone response delay, and other timing-related parameters. For instance, a digital hearing aid may have a demodulation delay in the order of milliseconds while an analog hearing aid may have a demodulation delay in the order of nanoseconds. Additionally, imperfections during manufacturing can cause two hearing aids of identical type to be associated with different timing parameters. Therefore, the inventors have contemplated training the mobile telephone such that unique parameters of hearing aids are accounted for, thereby enabling a generator within the mobile phone to synchronize an anti-phase acoustic burst with radio frequency interference at the hearing aid. For example, the mobile telephone can provide several default profiles, which can relate to hearing aid type, manufacturer, and/or the like. These profiles can be associated with approximate timing parameters with respect to a certain type of hearing aid. Thereafter, instructions can be provided to a user by way of a graphical user interface, wherein the instructions relate to informing the user of buttons to depress, for instance, to alter when an anti-phase acoustic burst is transmitted. Once the mobile phone has been trained, a profile specific to the user/hearing aid can be created and saved within the phone for later usage.

In another aspect, speech signals can be briefly cached prior to being transmitted to reduce occurrences of the anti-phase acoustic burst negatively impacting the speech signals.

Due to an amount of pauses in conventional speech, the caching should be seamless to the user of the mobile phone. Such selective caching can be undertaken by monitoring transmission slots and caching speech signals based at least in part upon such monitoring.

To the accomplishment of the foregoing and related ends, certain illustrative aspects are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
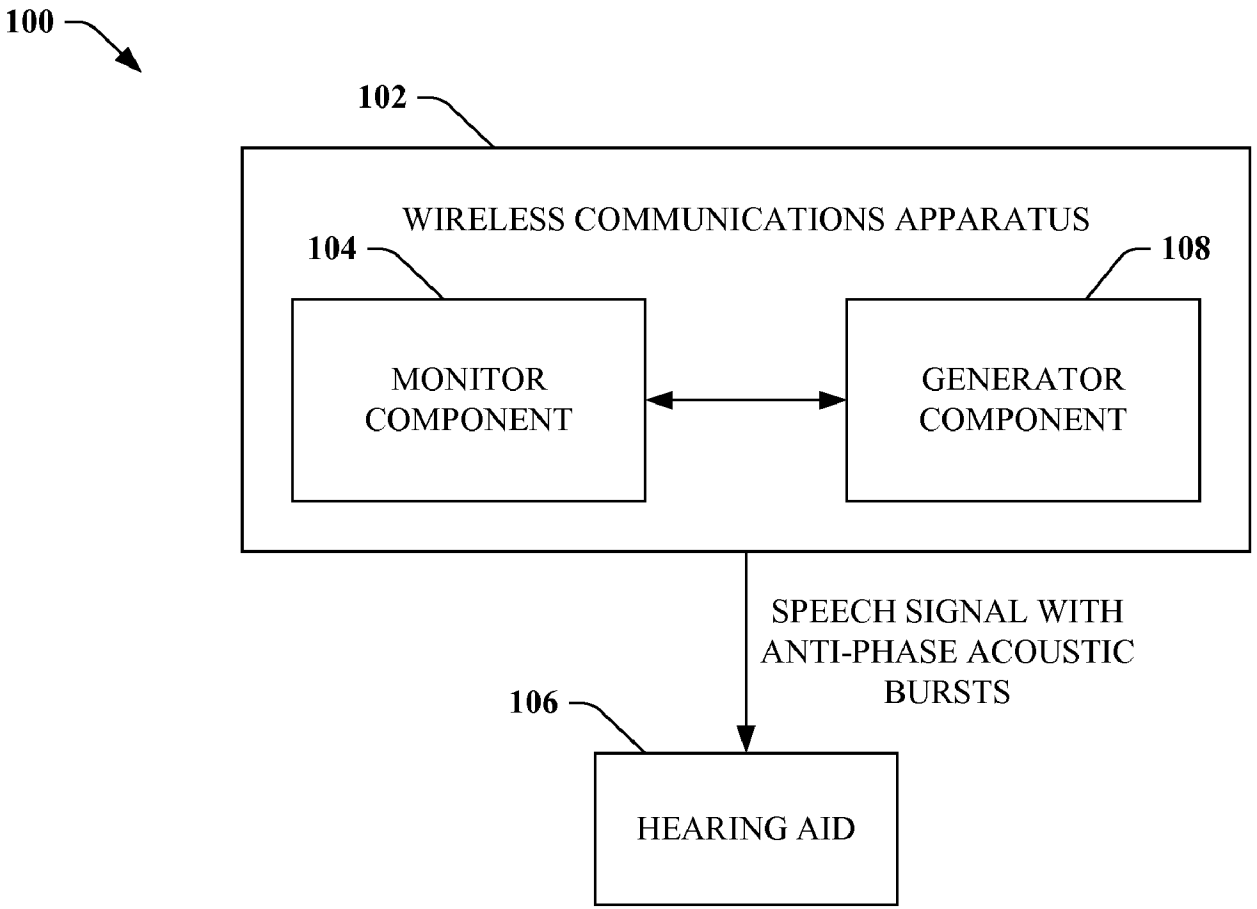
FIG. 1 is a high level block diagram of a system that facilitates reducing noise perceived by a user of a hearing aid, wherein the noise is caused by audible RF interference radiated by a wireless communications apparatus.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It may be evident, however, that such matter can be practiced without these specific details. In other instances, well-known structures and devices are shown in block diagram form in order to facilitate describing the claimed subject matter.

As used in this application, the terms "component" and "system" are intended to refer to a computer-related entity, either hardware, a combination of hardware and software, software, or software in execution. For example, a component can be, but is not limited to being, a process running on a processor, a processor, a hard disk drive, multiple storage drives (of optical and/or magnetic storage medium), an object, an executable, a thread of execution, a program, and/or a computer. By way of illustration, both an application running on a server and the server can be a component. One or more components can reside within a process and/or thread of execution, and a component can be localized on one computer and/or distributed between two or more computers.

Furthermore, the claimed subject matter may be implemented as a method, apparatus, or article of manufacture using standard programming and/or engineering techniques to produce software, firmware, hardware, or any combination thereof to control a computing device, such as a mobile handset, to implement the disclosed subject matter. The term "article of manufacture" as used herein is intended to encompass a computer program accessible from any computer-readable device, carrier, or media. For example, computer readable media can include but is not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick, key drive . . . ). Additionally it should be appreciated that a carrier wave can be employed to carry computer-readable electronic data such as those used in transmitting and receiving electronic mail or in accessing a network such as the Internet or a local area network (LAN). Of course, those skilled in the art will recognize many modifications may be made to this configuration without departing from the scope or spirit of the claimed subject matter.

Turning now to the drawings, FIG. 1 illustrates a system 100 that is utilized in connection with reducing radio frequency (RF) interference from mobile phones with respect to hearing aids. The system 100 includes a wireless communications apparatus 102, which can be or include a mobile telephone, a processor, memory, a memory card, or other suitable hardware/software that is associated with mobile telephones. Therefore, the apparatus 102 can include entities such as an antenna, a battery, and other components that can cause radiation of radio frequency signals that can be demodulated by a hearing aid. The wireless communications apparatus 102 includes a monitor component 104 that monitors operating parameters of a transmitter associated with the wireless communications apparatus 102, such as transmitter output power, frequency, etc.

To reduce a perceived amount of RF interference provided to a hearing aid 106, a generator component 108 can generate an acoustic anti-phase burst that is provided in conjunction with a speech signal to the hearing aid 106, wherein the anti-phase burst reduces effects of RF interference at the hearing aid 106 and is based at least in part upon the monitored operating parameters. For example, the generator component 108 can determine a phase and amplitude associated with RF interference and can create an acoustic burst with an appropriate amplitude and phase that is opposite of the phase of the demodulated RF interference. Thus, RF interference demodulated at the hearing aid 106 can be greatly reduced.

The generator component 108 can also be configured to adapt to changing environmental and/or wireless network conditions. For instance, amounts of RF radiation can change as a frequency band associated with a call alters. Thus, if a frequency hop occurs, the generator component 108 can recognize such hop and a change in RF radiations that result from the frequency hop. In another example, a user's geographic location with respect to one or more transmitting powers can affect an amount of RF signal that is emitted from a mobile telephone. Accordingly, the generator component 108 can recognize alterations in RF radiations and can adjust a phase and/or amplitude of an anti-phase acoustic burst output therefrom. Moreover, it is possible that an anti-phase acoustic burst can have a negative impact on a speech signal—the generator component 108 can take into account speech signal quality when generating an anti-phase acoustic burst. For instance, the generator component 108 may output an anti-phase acoustic burst that does not entirely cancel RF radiations demodulated by the hearing aid 106 to ensure that quality of speech received at the hearing aid 106 is at or above a threshold quality.

Figure 2:
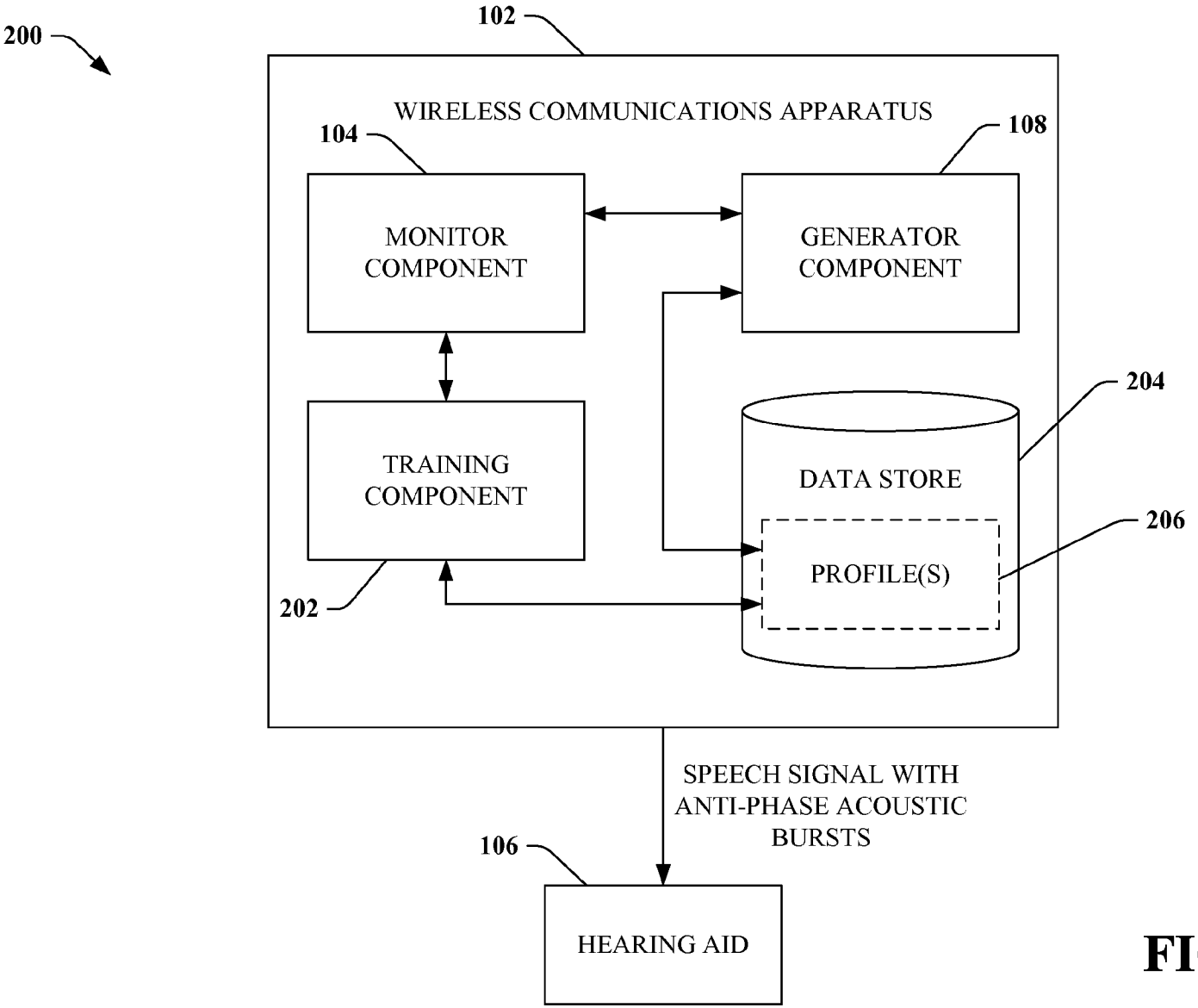
FIG. 2 illustrates a system for training a wireless communications apparatus to reduce audible RF interference perceived by a user of a hearing aid.

Now referring to FIG. 2, a system 200 that facilitates reduction of RF interference that is audible to users of hearing aids is illustrated. The system 200 includes the wireless communications apparatus 102, which, as described above, can be a mobile telephone, a portion of a mobile telephone, and/or the like. The wireless communications apparatus can include a training component 202 that can be utilized in connection with training the generator component 108 with respect to a particular hearing aid. In more detail, different hearing aids can be associated with unique properties, such as microphone response time and amplifier processing delay. Therefore, the training component 202 can be employed to synchronize anti-phase acoustic bursts output by the generator component 108 with a transmitter associated with the wireless communications apparatus 102 while compensating for at least the aforementioned hearing aid properties.

To undertake such training, the training component 202 can access a data store 204 that can include one or more profiles 206. For example, the profiles 206 can be default profiles that can be associated with a particular hearing aid manufacturer, a type of hearing aid (e.g., analog versus digital), and the like. The default profiles can be associated with approximate time delays, thereby reducing an amount of time a user otherwise may have to spend on training the generator component 108. Upon a default profile being selected (either automatically or manually by a user), the training component 202 can be employed to output interactive graphical displays that enable the user to adjust timing settings associated with the generator component 108. For instance, the graphical displays can request that a user hold the phone as if they were using it to speak and listen for undesirable audible signals resultant from RF interference. The user can then depress one or more buttons, enter voice commands, and/or the like until the undesirable audible signals are sufficiently reduced (or substantially cancelled). In other words, the training component 202 can train the generator component 108 to substantially match anti-phase acoustic bursts output therefrom with unique properties of the user's hearing aid under the conditions (e.g., transmitted RF power, frequency, . . . ) in use by the wireless communications device 102 at the time the training process is invoked. This initial training information can be used by the generator component 108 to alter the amplitude and phase of the anti-phase acoustic bursts as the operating parameters of wireless communications device 102 change dynamically during use. A resultant profile that includes this information for a given hearing aid can then be retained within the data store 204 and accessed when such user is utilizing the wireless communications apparatus 102.

The following example is provided to better illustrate utilization of the training component 202. A user of the hearing aid 106 may be utilizing the wireless communications apparatus 102 for a first time. Prior to utilizing the wireless communications apparatus for purposes of voice communications, the user of the hearing aid 106 can access a menu and indicate to the wireless communications apparatus 102 that such user employs the hearing aid 106. The user can then be provided with instructions for selecting a default profile based at least in part upon a manufacturer of the hearing aid and/or a type of hearing aid. In another example, a single default profile can be existent within the data store 204 (thereby eliminating a need for the user to select a default profile). Moreover, rather than providing graphical displays to the user, audible commands or other suitable man-machine interfaces can be employed.

In still another example, a user may not be required to provide input relating to type of hearing aid, manufacturer of a hearing aid, and the like. Rather, a sensor component (not shown) can sense a type or manufacturer of hearing aid when such hearing aid becomes proximate to the wireless communications apparatus 102. Thus, for instance, the hearing aid 106 and the wireless communications apparatus 102 can communicate by way of Bluetooth, by way of a Near Field communications, or other suitable protocol. In yet another example, the wireless communications apparatus 102 may be associated with digital camera functionality, and it may be able to capture a photograph of the hearing aid 106 and analyze the photograph to determine a type and/or manufacturer of the hearing aid 106 or capture a barcode on the hearing aid 106 and perform a barcode scan operation. Still further, the hearing aid 106 may be equipped with an interface that enables the wireless communications apparatus to be wired to the hearing aid 106, and information relating to the hearing aid 106 can be provided by way of such wired connection. The wireless communications apparatus 102 can be updated with latest hearing aid profiles by accessing or being provided with updated libraries that include such profiles. Contents of the libraries can be downloaded to the phone over the air and/or through a side load to a computing device, such as a PC, a PDA, etc. A default profile can thereafter be automatically selected based upon determined type and/or manufacturer of the hearing aid 106.

Once a default profile has been selected, the user can be prompted to place the wireless communications apparatus 102 as if they were utilizing such apparatus 102 to effectuate wireless communications. The user can afterwards be prompted to perform adjustments that effectively reduce unwanted noise (caused by RF interference) perceived by the user of the hearing aid 106. Once the user of the hearing aid 106 is satisfied, a profile for such hearing aid can be stored within the data repository 204 and can be accessed at any suitable time by the user. Thus, multiple users can use the wireless communications apparatus 102, wherein each user can select a particular profile to reduce perceived effects of RF interference. The monitor component 104 can analyze transmitter operating parameters of the apparatus 102, and these parameters can be employed by the generator component 108 (together with profile information) in connection with outputting an anti-phase acoustic burst that reduces perceived affects of the RF interference. The generator component 108 can output such burst according to timing parameters determined during training (as retained within a stored profile).

Therefore, in summary, the system 200 can utilize profile data in conjunction with knowledge of transmitter operating parameters of the wireless communications apparatus 102 to reduce undesirable noise perceived by users of hearing aids. For example, when a user invokes a training sequence to reduce interference to the hearing aid 106, the wireless communications apparatus 106 can monitor and track transmitter output power, frequency, etc. that are in use at the time. Such information can be utilized to create an algorithm that can be employed by the wireless communications apparatus 106 to dynamically produce anti-phase bursts as the transmitter characteristics alter. These changes often occur (rapidly) in a field environment.

Figure 3:
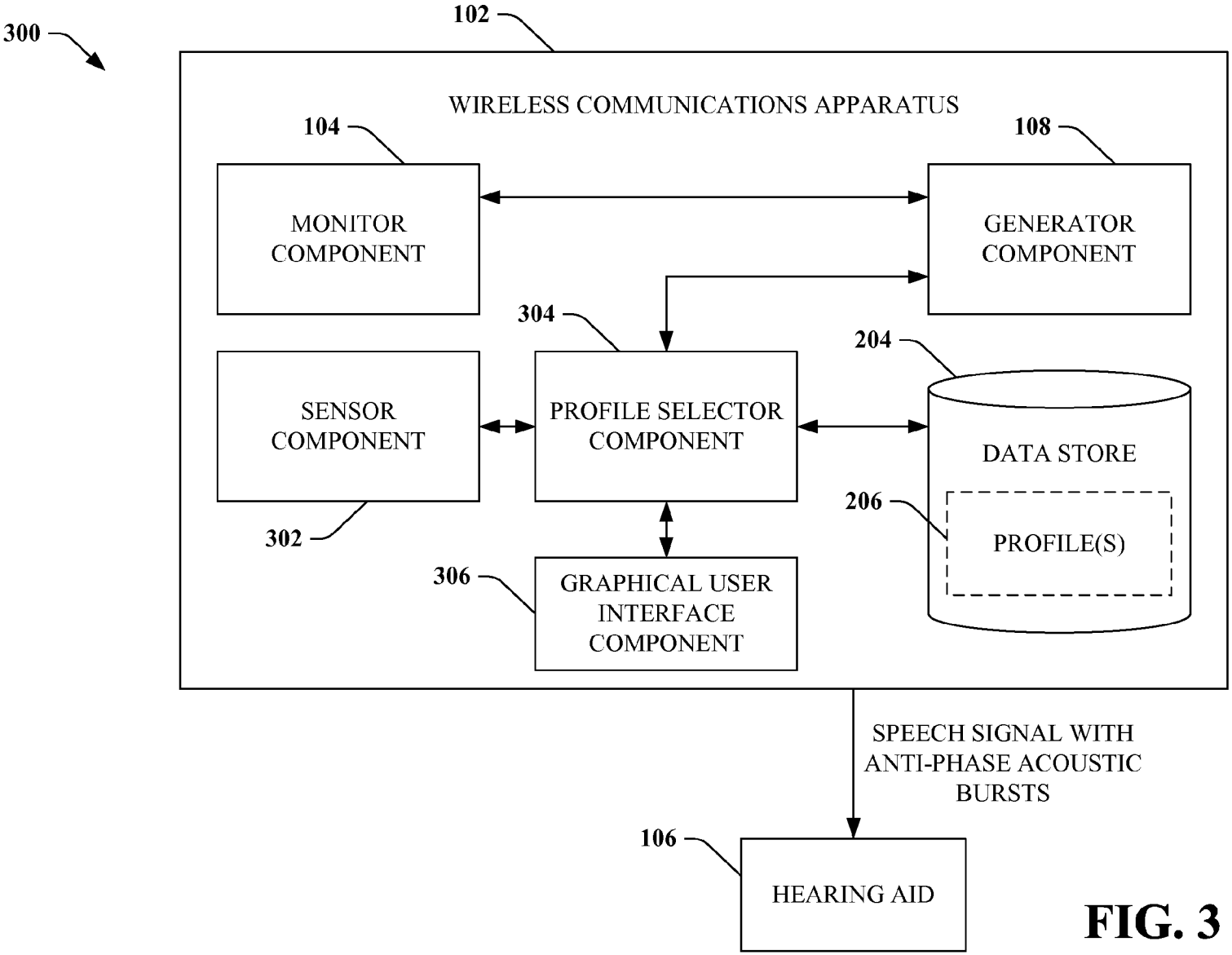
FIG. 3 illustrates a system for reducing noise perceived by a user of a hearing aid through automatic selection of a profile.

With reference now to FIG. 3, a system 300 that facilitates reducing audible interference at the hearing aid 106 caused by RF radiations emitted by the wireless communications apparatus 102 is illustrated. The system 300 includes the wireless communications apparatus 102, which can include a sensor component 302. The sensor component 302 can be employed in connection with sensing user input, such as voice input, depression of keys, sensing biometric indicia (e.g., fingerprint data), and/or the like. Additionally or alternatively, the sensor component 302 can sense external contextual data, including orientation of the wireless communications apparatus 102 (e.g., whether the apparatus 102 is being held to a left ear or a right ear), temperature, location of an earpiece with respect to the hearing aid 106, and/or the like.

The wireless communications apparatus 102 can additionally include a profile selector component 304 that can select a profile from within the data store 204 based at least in part upon data sensed by the sensor component 302. For example, two users may share use of the wireless communications apparatus 102, such that different profiles should be associated with the different users. A user can enter identification information, such as a personal identification number, into the wireless communications apparatus 102, and the entry can be sensed by the sensor component 302. The sensor component 302 can inform the profile selector component 304 that a particular profile within the data store 204 should be utilized when generating anti-phase acoustic bursts (based upon the user ID).

In another example, the sensor component 302 can sense an orientation of the wireless communications apparatus 102 with respect to a user. For instance, a user may use different hearing aids in different ears, and thus different profiles may exist for disparate ears with respect to different users. The sensor component 302 can detect when the wireless communication apparatus 102 rotates about an axis in a certain amount of time, thus indicating that the user has translated the wireless communications apparatus 102 from a left ear to a right ear, for example. Such sensed transition can be provided to the profile selector component 304, which can thereafter select a profile that accords to the sensed information. Still further, information such as temperature, humidity, and the like can cause a profile to change or a parameter of a profile to change. The sensor component 302 can be configured to sense such information and the profile selector component 304 can select a profile based upon the sensed data. In still another example, as described above, the wireless communications apparatus can automatically determine identity of the hearing aid through, for instance, a wired connection therebetween, a wireless connection therebetween, use of photograph analysis, etc.

The wireless communications apparatus 102 can also include a graphical user interface component 306 that can output or display sensed parameters, available profiles, and the like. Thus, the graphical user interface component 306 can be employed to provide a user with text, graphics, and/or speech that aids the user in selecting a profile and/or displaying to the user a selected profile. In an example, a user of the hearing aid 106 can have previously selected a profile from within the data store 204, such that audible interference associated with RF signals radiated from the wireless communications apparatus 102 is reduced through the generator component 108 emitting anti-phase acoustic burst(s). The user may then transition the phone from an ear associated with the hearing aid 106 to her other ear. The sensor component 302 can detect that the orientation of the wireless communications apparatus 102 has altered, and such sensed alteration can be provided to the profile selector component 304. The profile selector component 304 can automatically select a profile from the data store 204 that is associated with the second ear, and the generator component 108 can utilize such profile in connection with reducing audible RF interference. Additionally, the graphical user interface component 306 can generate a graphical indication to the user that a profile has been automatically altered.

Figure 4:
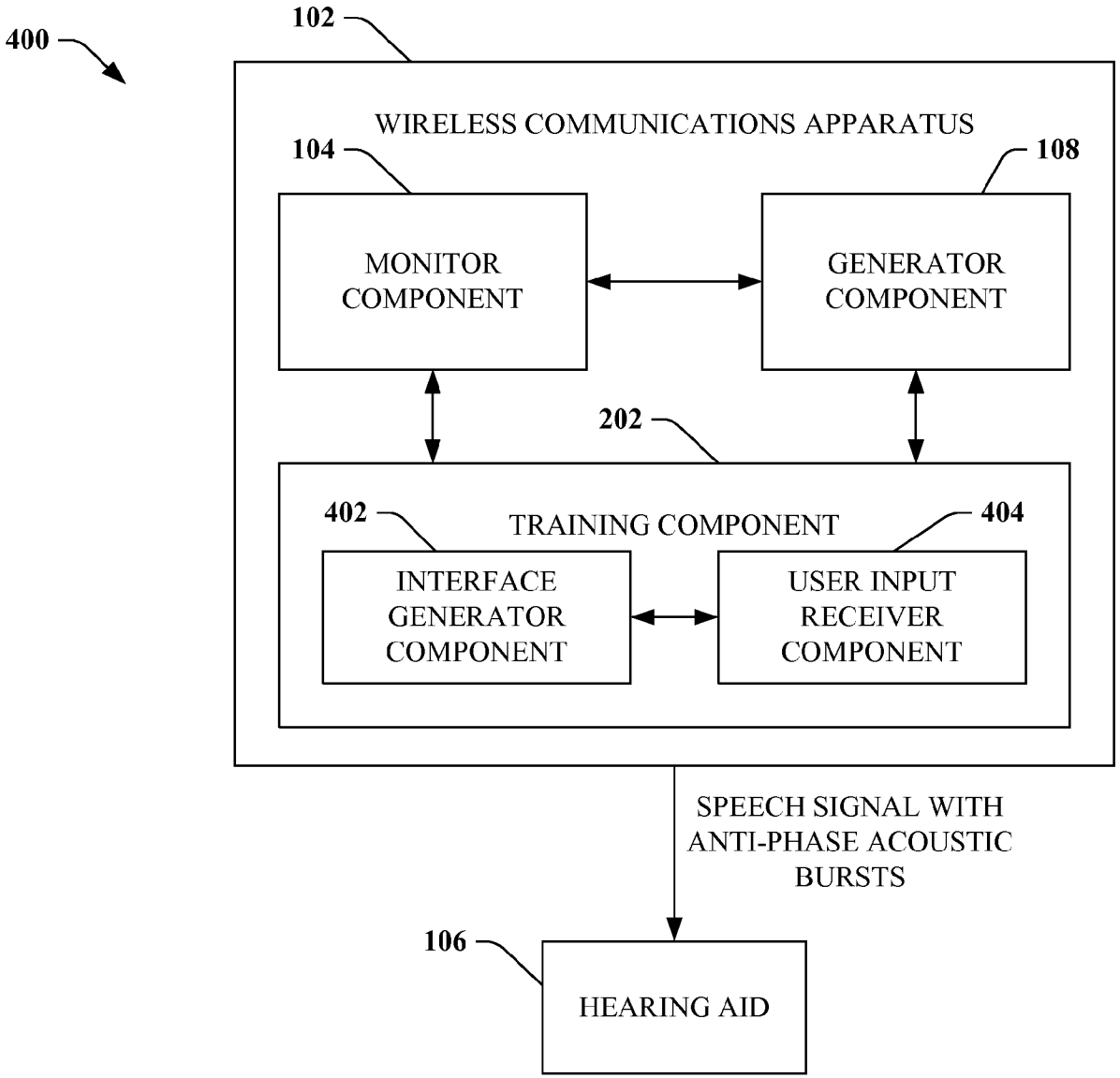
FIG. 4 illustrates a system for training a wireless communications apparatus.

Turning now to FIG. 4, a system 400 that facilitates training a wireless communications apparatus to effectively reduce audible interference demodulated by hearing aids caused by radiated RF signals from the apparatus is illustrated. The system 400 includes the wireless communications apparatus 102 that is utilized to provide speech signals or other audible signals to a user of the hearing aid 106. The wireless communications apparatus can include the training component 202, which can be utilized to estimate/determine timing information associated with a transmitter (not shown) and the hearing aid 106. As stated above, transmission of the anti-phase acoustic burst should be synchronized with respect to unique characteristics of the hearing aid 106, thereby ensuring that the acoustic burst emitted by the generator component 108 effectively reduces audible interference perceived by a user of the hearing aid 106.

To enable this synchronization, the wireless communications apparatus 102 can include the training component 202, which in turn can be associated with an interface generator component 402. The interface generator component 402 can display one or more instructions to a user of the wireless communications apparatus 102 with respect to synchronizing the generator component 108 (through use of a profile). For example, the interface generator component 402 can provide instructions for depressing certain keys to alter timing in particular directions. Screens can be provided in a specific sequence to enable efficient synchronization of the generator component 108. A user input receiver component 404 can receive user input that is provided in response to instructions displayed through use of the interface generator component 402. For instance, a series of screens displaying the question "is noise reduced or enhanced?" can be provided as the generator component 108 is synchronized through use of the training component 202, and the user input receiver component 404 can facilitate receipt of such input. Thereafter, screens generated by the interface generator component 402 can be based at least in part upon input received from the user input receiver component.

In another example, the interface generator component 402 can output screens that enable multidimensional input to be utilized to train the wireless communications apparatus. For instance, voice recognition (e.g., a statement indicating that a sample is associated with echo and needs reduced volume), two dimensional graphical user interfaces, a set of slider bars, and the like can be utilized to acquire parameters in multiple dimensions concurrently.

Figure 5:
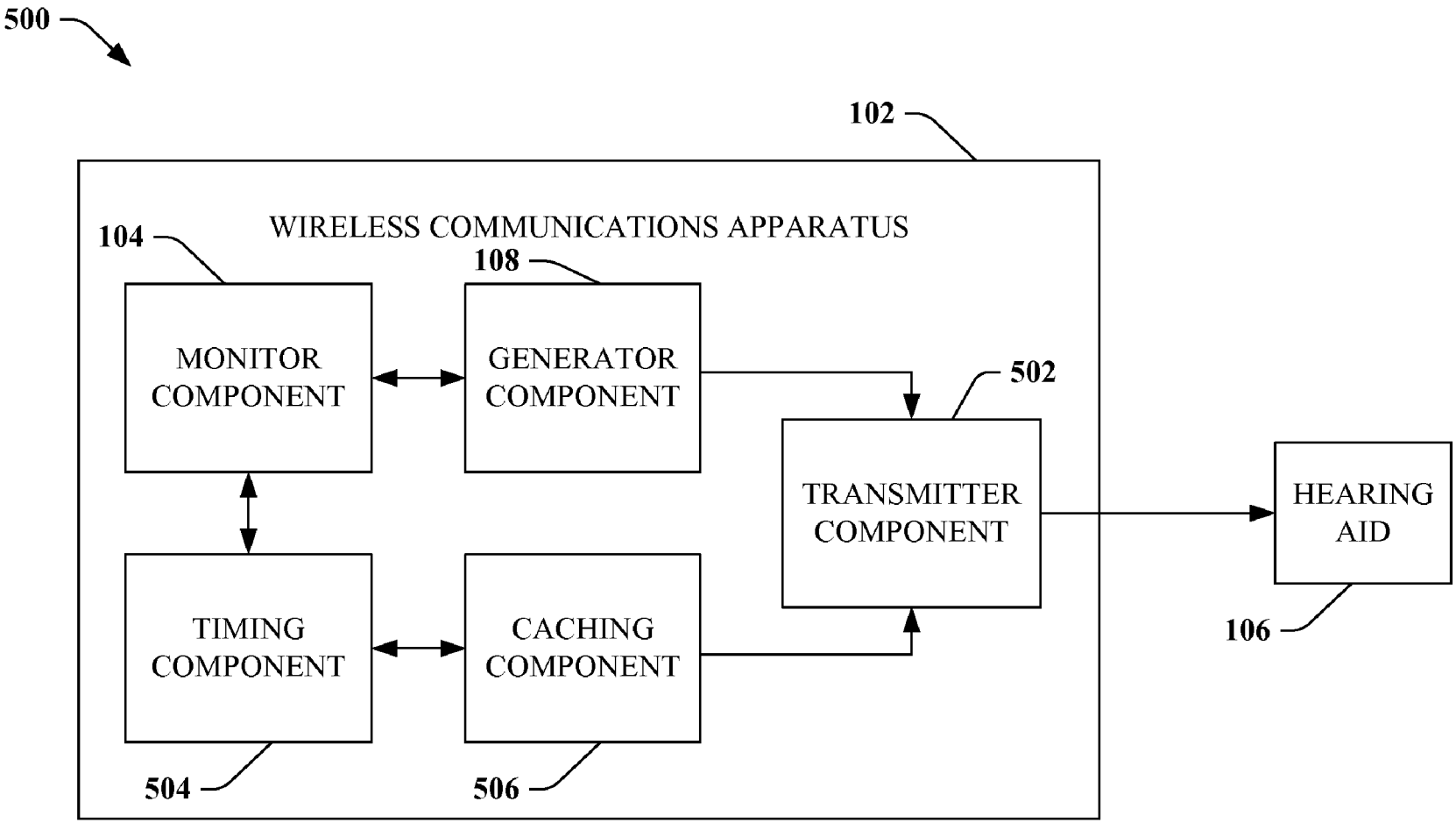
FIG. 5 illustrates a system for caching speech signals such that an acoustic burst emitted from a wireless communications apparatus does not sufficiently negatively impact the speech signals.

Now referring to FIG. 5, a system 500 that facilitates reducing perceived noise at a hearing aid through reducing affects of RF interference caused by a mobile phone is illustrated. Thus, through employment of at least portions of the system 500, users of hearing aids can utilize mobile telephones for voice communications. The system 500 includes the wireless communications apparatus 102 which can include the monitor component 104. The system 500 additionally includes the generator component 108 that can generate anti-phase acoustic bursts to reduce, for instance, a "buzzing" noise perceived by a user of the hearing aid 106.

The anti-phase acoustic burst can be provided to a transmitter component 502 that is utilized to transmit signals from the wireless communications apparatus 102 to the hearing aid 106. In an example, the transmitter component 502 can transmit the anti-phase acoustic burst (together with voice signals)

to an earpiece associated with the wireless communications apparatus 102 (in the case of acoustic coupling between a mobile telephone and the hearing aid 106) or to a mobile telephone's "T-coil" (in the case of magnetic induction coupling of audio from a mobile telephone to a T-coil equipped hearing aid). In some instances, however, the anti-phase acoustic burst generated by the transmitter component 502 can interfere with speech signals that are desirably provided to a user of the hearing aid 106. To reduce occurrences of such interference, a timing component 504 can be employed to monitor (continuously) a time slot used for transmission such that the anti-phase acoustic burst will be properly synchronized, especially since the time slot may alter during a call. Because the wireless communications apparatus 102 has knowledge of time slot(s) in use, the timing component 504 can be employed to adjust timing of the anti-phase acoustic burst accordingly. Moreover, the timing component 504 can be used with respect to reducing interference of the anti-phase acoustic burst with the speech signal through offsetting (in time) the anti-phase cancellation burst relative to the wireless communication device's receive speech audio. In other words, the receive audio (received speech signals) can be delayed according to timing parameters of the timing component to allow blanking of a transmitted anti-acoustic burst. Under such conditions, it may be desirable for the wireless communications apparatus to generate some sort of "comfort" noise to mask the effects of the anti-phase bursts.

To aid in delaying speech audio, a caching component 506 can be employed that caches audio signals desirably provided to the user of the hearing aid 106, wherein the caching component 506 caches the signals according to timing parameters determined by the timing component 504. Thus, in other words, the timing component 504 and the caching component 506 can act in conjunction to adaptively cache speech audio to allow anti-phase acoustic bursts to be generated by the generator component 108 to reduce "buzzing" heard by a user of the hearing aid 106. The caching can occur over a segment of time that is sufficient enough in length to generate anti-phase acoustic bursts. The delays can be compensated for during pauses in speech over the course of a call.

Figure 6:
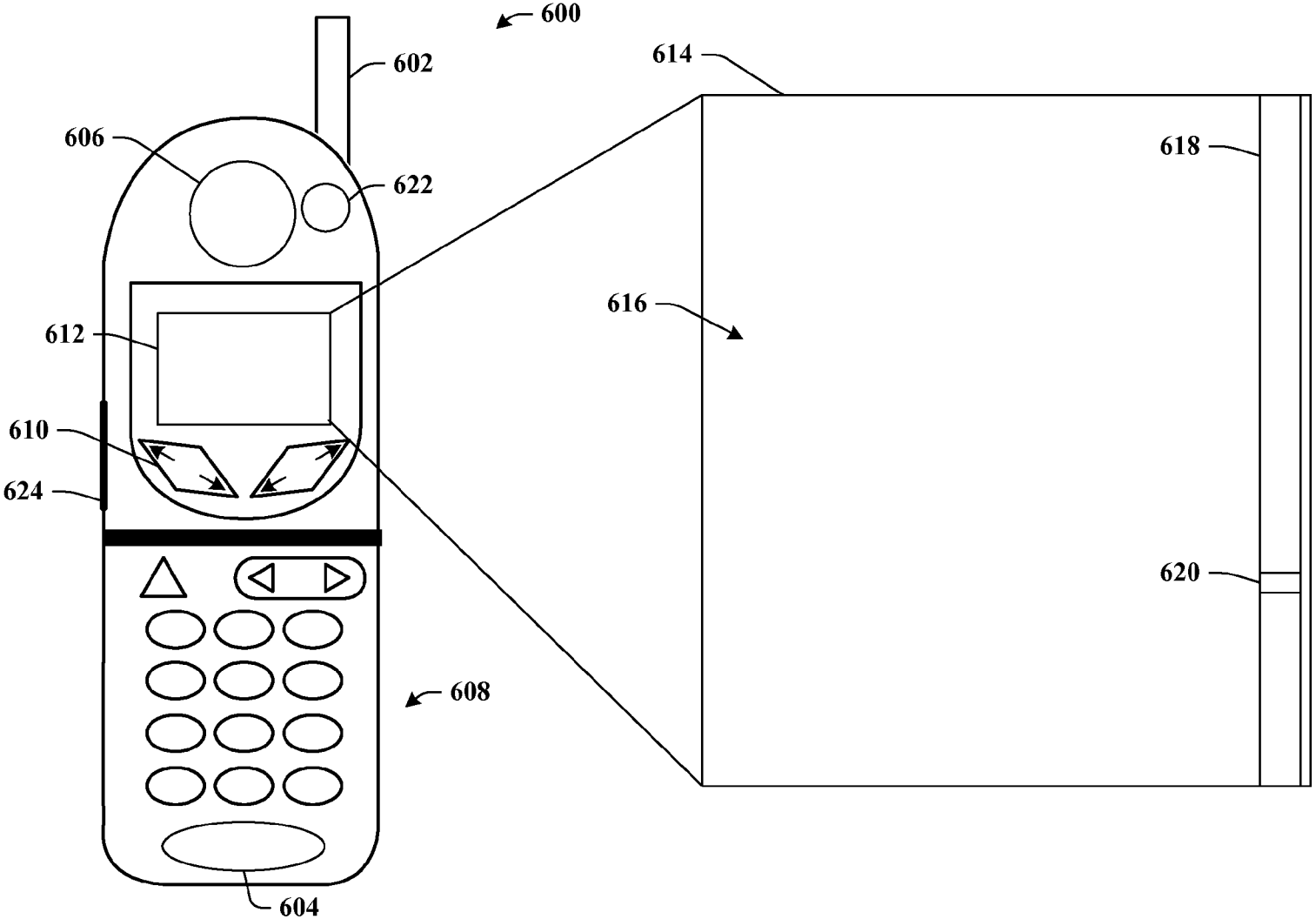
FIG. 6 illustrates an example mobile telephone.

FIG. 6 illustrates an example mobile (e.g., portable and wireless) telephone 600 that can output anti-phase acoustic bursts to a user of a hearing aid as described herein. The mobile telephone 600 includes an antenna 602 that communicates (e.g., transmit and receive) radio frequency signals with one or more base stations. While shown as protruding a casing of the mobile telephone 600, it is understood that the antenna 602 can be housed within a casing the mobile telephone 600. The antenna 602 can be coupled to duplexer circuitry (e.g., as described herein) within the mobile telephone 600. In addition, the mobile telephone 600 can include a separate signal-receiving component (not shown) that can also be coupled to the duplexer.

The mobile telephone 600 can also include a microphone 604 that receives audio signals and conveys the signals to at least one on-board processor for audio signal processing, and an audio speaker (proximate to an earpiece) 606 for outputting audio signals to a user, including processed voice signals of a caller and recipient music, alarms, and notification tones or beeps. Moreover, the audio speaker 606 can be associated with outputting anti-phase acoustic bursts to a user of a hearing aid. Additionally, the mobile telephone 600 can include a power source such as a rechargeable battery (e.g., Alkaline, NiCAD, NiMH and Li-ion), which can provide power to substantially all onboard systems when the user is mobile.

The mobile telephone 600 can further include a plurality of multi-function buttons including a keypad 608, menu navigating buttons 610 and on-screen touch sensitive locations (not shown) to allow a user to provide information for dialing numbers, selecting options, navigating the Internet, enabling/disabling power, training the mobile telephone 600 to output anti-phase acoustic bursts while accounting for unique hearing aid properties, and navigating a software menu system including features in accordance with telephone configurations.

A display 612 can be provided for displaying information to the user such as training screens, a dialed telephone number, caller telephone number (e.g., caller ID), notification information, web pages, electronic mail, and files such as documents, spreadsheets and videos. The display 612 can be a color or monochrome display (e.g., liquid crystal, CRT, LCD, LED and/or flat panel), and can be employed concurrently with audio information such as beeps, notifications and voice. Where the mobile telephone 600 is suitable for Internet communications, web page and electronic mail (e-mail) information can also be presented separately or in combination with the audio signals.

In an example, the display 612 can be utilized in connection with a graphical user interface (GUI) 614. The GUI 614 can include a viewing window 616 where data (e.g., instructions) can be displayed to the user. The user can navigate through the data via a slider 618 and a scroll bar 620. For instance, instructions can be provided in connection with training the mobile telephone 600, and a user can use the slider 618 and/or the scroll bar 620 in connection with reading the instructions and providing feedback in accordance with the instructions. The menu navigating buttons 610 can further enable the user to interact with the display information. In support of such capabilities, the keypad 608 can provide keys that facilitate alphanumeric input, and are multifunctional such that the user can respond by inputting alphanumeric and special characters via the keypad 608. The keypad keys also allow the user to control at least other telephone features such as audio volume and display brightness.

An interface can be utilized for uploading and downloading information to memory, for example, the reacquisition time data to the telephone table memory, and other information of the telephone second memory (e.g., website information and content, caller history information, address book and telephone numbers, and music residing in the second memory). A power button 622 allows the user power on and off the mobile telephone 600. The mobile telephone 600 can further include memory for storing information. The memory can include non-volatile memory and volatile memory, and can be permanent and/or removable. The mobile telephone 600 can further include a high-speed data interface 624 such as USB (Universal Serial Bus) and IEEE 1394 for communicating data with a computer. Such interfaces can be used for uploading and downloading information, for example website information and content, caller history information, address book and telephone numbers, and music residing in the second memory. In addition, the mobile telephone 600 can communicate with various input/output (I/O) devices such as a keyboard, a keypad, and a mouse.

Figure 7:
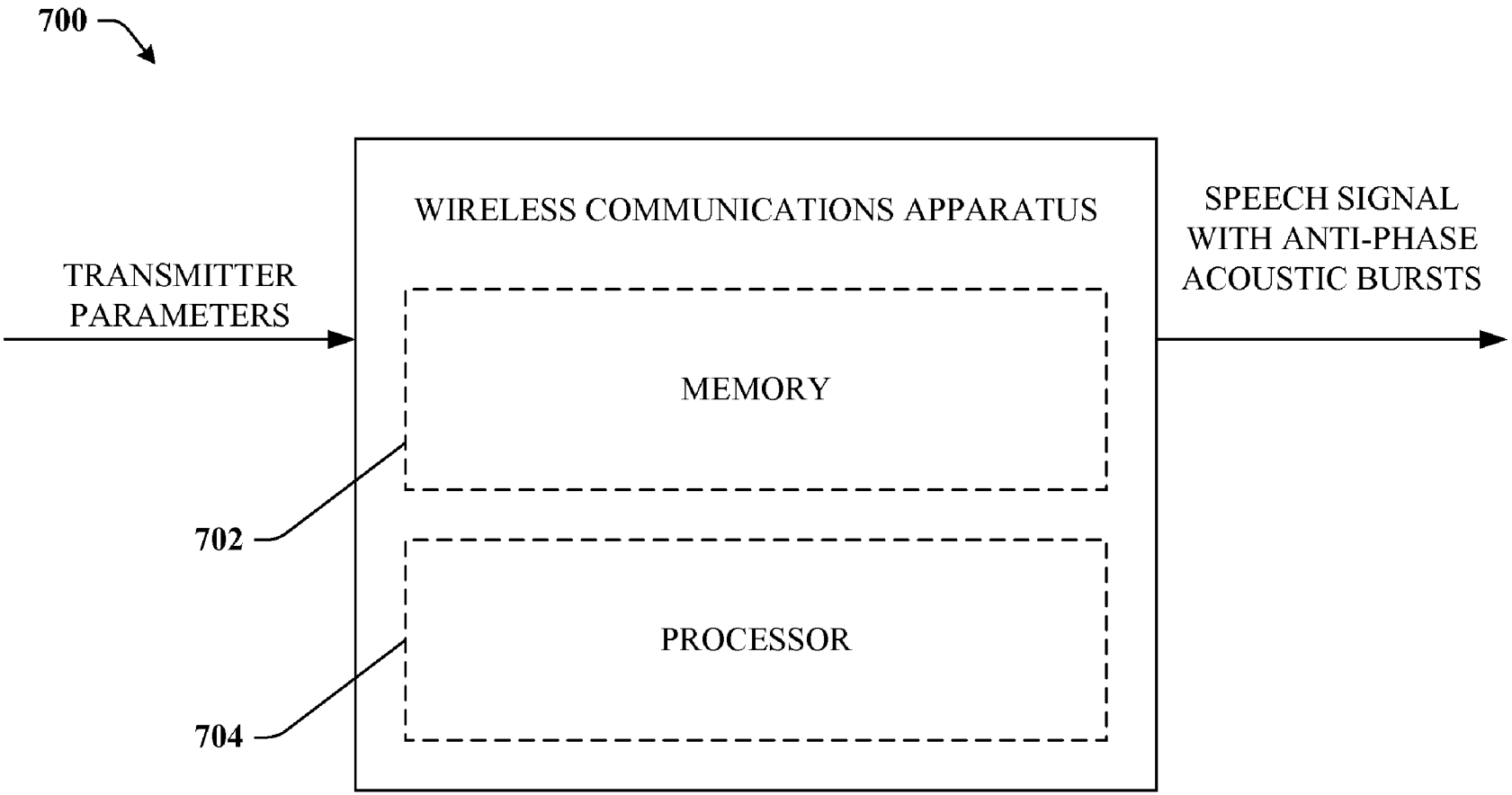
FIG. 7 illustrates an example wireless communications apparatus.

Now referring to FIG. 7, a wireless communications apparatus 700 that can be configured to generate an acoustic anti-phase burst to effectively reduce audible RF interference associated with the apparatus 700 is illustrated. The wireless communications apparatus 700 can include a memory 702, which can be RAM, ROM, a hard drive, or any other suitable memory. The memory 702 can include instructions for monitoring transmitter parameters and further instructions for generating an anti-phase acoustic burst to aid in canceling RF interference perceived by users of hearing aids. The wireless communications apparatus 700 can also include a processor 704 that can execute such instructions.

Figure 8:
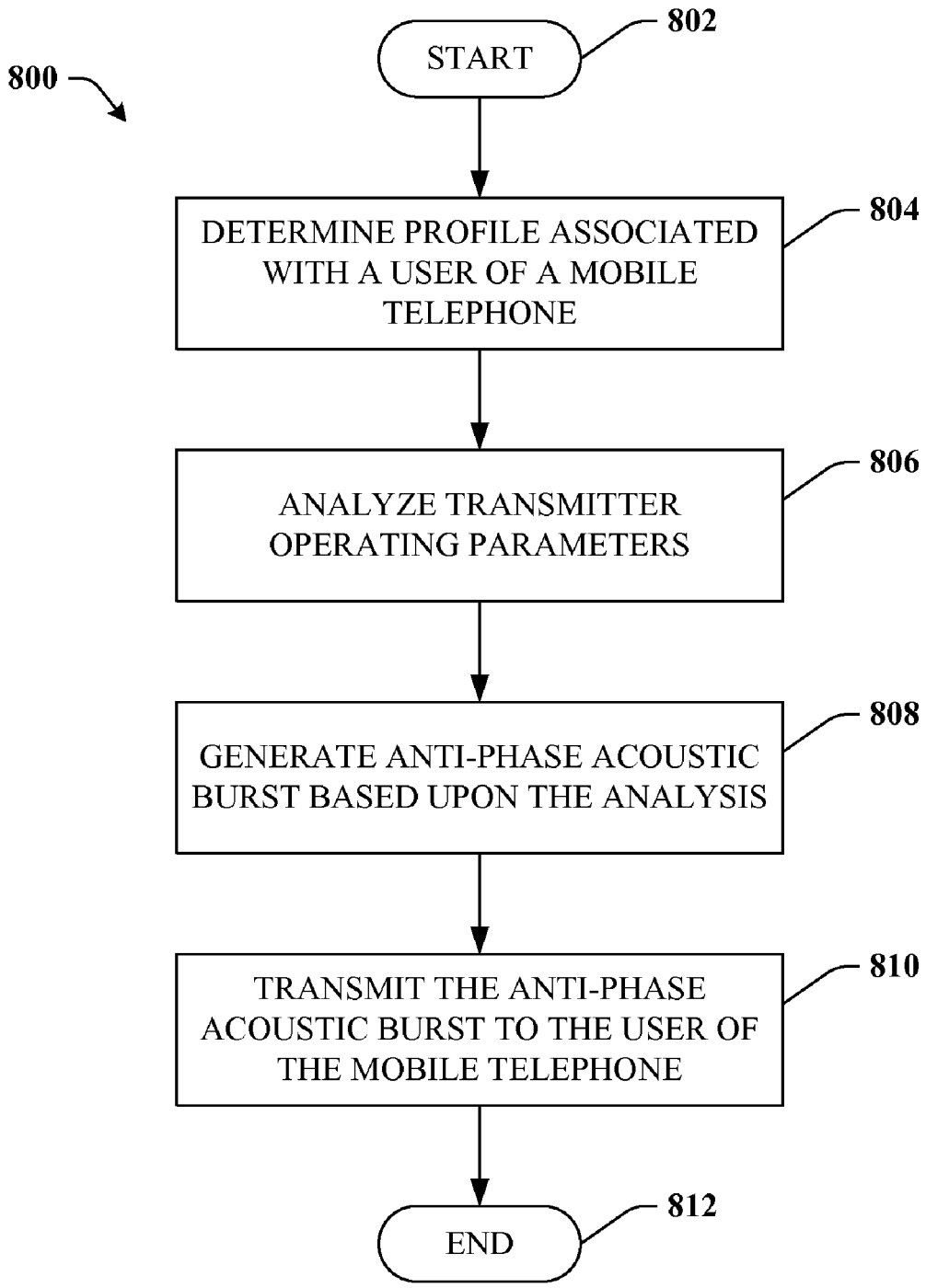
FIG. 8 is a representative flow diagram illustrating a methodology for transmitting an anti-phase acoustic burst to a user of a mobile phone.
Figure 9:
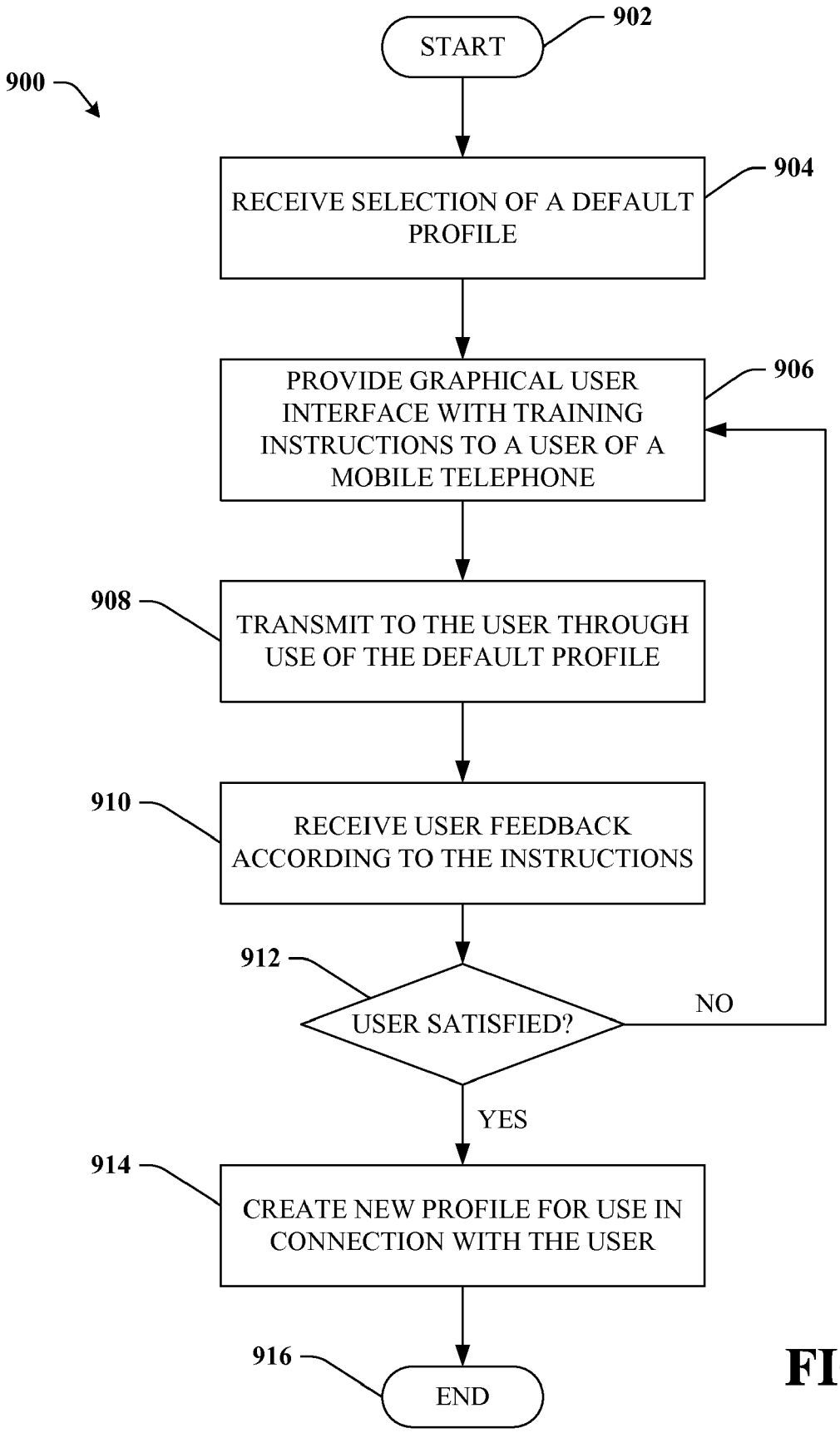
FIG. 9 is a representative flow diagram illustrating a methodology for training a profile for use in connection with generating anti-phase acoustic bursts.
Figure 10:
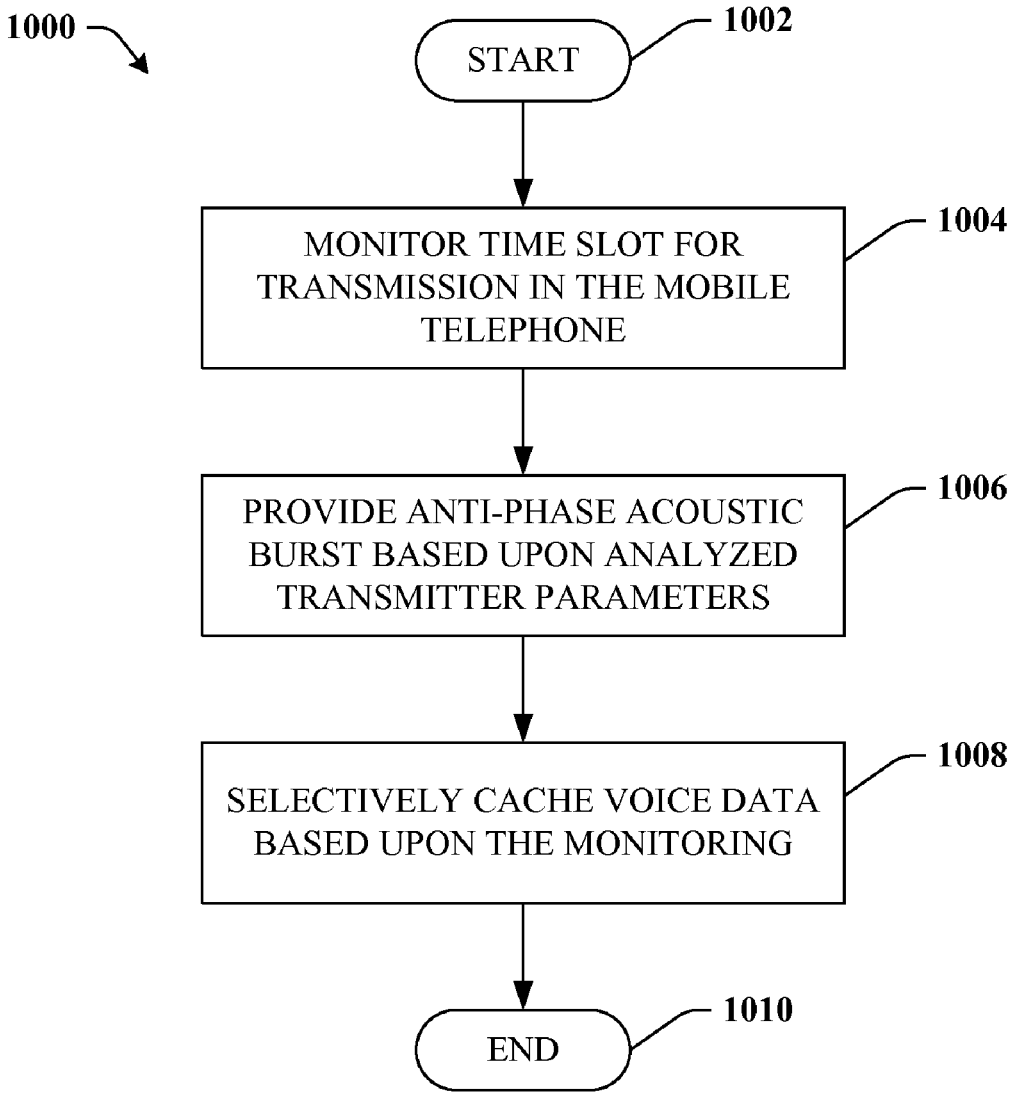
FIG. 10 is a representative flow diagram illustrating a methodology for selectively caching voice signals.

Referring to FIGS. 8-10, methodologies in accordance with various aspects of the claimed subject matter are illustrated. While, for purposes of simplicity of explanation, the methodologies are shown and described as a series of acts, it is to be understood and appreciated that the claimed subject matter is not limited by the order of acts, as some acts may occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the claimed subject matter. Additionally, it should be further appreciated that the methodologies disclosed hereinafter and throughout this specification are capable of being stored on an article of manufacture to facilitate transporting and transferring such methodologies to computers. The term article of manufacture, as used herein, is intended to encompass a computer program accessible from any computer-readable device, carrier, or media.

Turning specifically to FIG. 8, a methodology 800 for reducing RF interference perceived by a user of a hearing aid is illustrated. For instance, a mobile telephone can be configured to execute the methodology 800. The methodology 800 starts at 802, and at 804 a profile associated with a user of a mobile telephone is determined. The profile can include information that enables a transmitted of the mobile telephone to output an anti-phase acoustic burst to substantially cancel RF interference perceived by the user of the hearing aid. More particularly, a mobile telephone may be associated with unique characteristics, such as microphone response delay.

At 806, parameters associated with a transmitter are analyzed, wherein the parameters can be indicative of RF interference that will be perceived by a user of a hearing aid. At 808, an anti-phase acoustic burst is generated based at least in part upon the analysis. For instance, the anti-phase acoustic burst can be generated to reduce a "buzzing" noise that is perceived by the user of the hearing aid. At 810, the anti-phase acoustic burst is provided to the mobile telephone together with voice signals or other audible signals. The methodology 800 then completes at 812.

Now referring to FIG. 9, a methodology 900 for creating a profile that can be utilized in connection with determining timing information associated with transmitting an anti-acoustic phase burst is illustrated. For example, a mobile telephone can be configured to implement the methodology 900. The methodology 900 starts at 902, and at 904 a selection of a default profile is received. This selection can be automatically undertaken, can be selected by a user based on a type of hearing aid, type of phone, manufacturer of a hearing aid, and/or the like. For example, a user with a digital hearing aid can select a profile associated with digital hearing aids by depressing one or more keys on a keypad of the mobile telephone. At 906, one or more graphical user interface with that includes instructions for training a mobile telephone to reduce unwanted audible interference is generated. For example, the instructions can include instructions relating to certain keys to press that alter timing parameters associated with generating an anti-phase acoustic burst.

At 908, signals are transmitted to the user, wherein such signals include an anti-phase acoustic burst that is intended to offset audible RF interference. If timing is incorrect, however, at least a portion of the audible RF interference can be heard by a user of a hearing aid. At 910, user feedback per the instructions is received. For instance, the user can manually increase or decrease delays in outputting an anti-phase acoustic burst by providing voice commands per the instructions, selecting one or more keys, and the like. At 912, a determination is made regarding whether the user is satisfied (e.g., whether the user does not perceive audible RF interference through an earpiece of the mobile telephone). If the user is not satisfied, the methodology 900 returns to 906, where further instructions are provided to the user. If the user is satisfied, then at 914 a new profile is created that reflects the user input, and such profile can be stored to memory for use when the user is utilizing the mobile telephone. The methodology 900 then completes at 916.

With reference now to FIG. 10, a methodology 1000 (which can be executed by a mobile telephone) for transmitting speech signals to a user with a hearing aid is illustrated. The methodology 1000 starts at 1002, and at 1004 time slots for transmission with respect to a mobile phone are monitored. For instance, the mobile phone is aware of when it is transmitting, even when time slots are altered during a call. At 1006, an anti-phase acoustic burst is generated based upon monitored transmitter parameters. Such burst can be designed to audibly cancel RF interference that will be perceived by users of hearing aids. In some instances, however, the anti-phase acoustic burst may negatively affect speech signals. Accordingly, at 1008 voice data (speech signals) are selectively cached and transmitted after a short period of time to reduce negative affects of the anti-phase acoustic burst on the speech data. The methodology 1000 completes at 1010.

Figure 11:
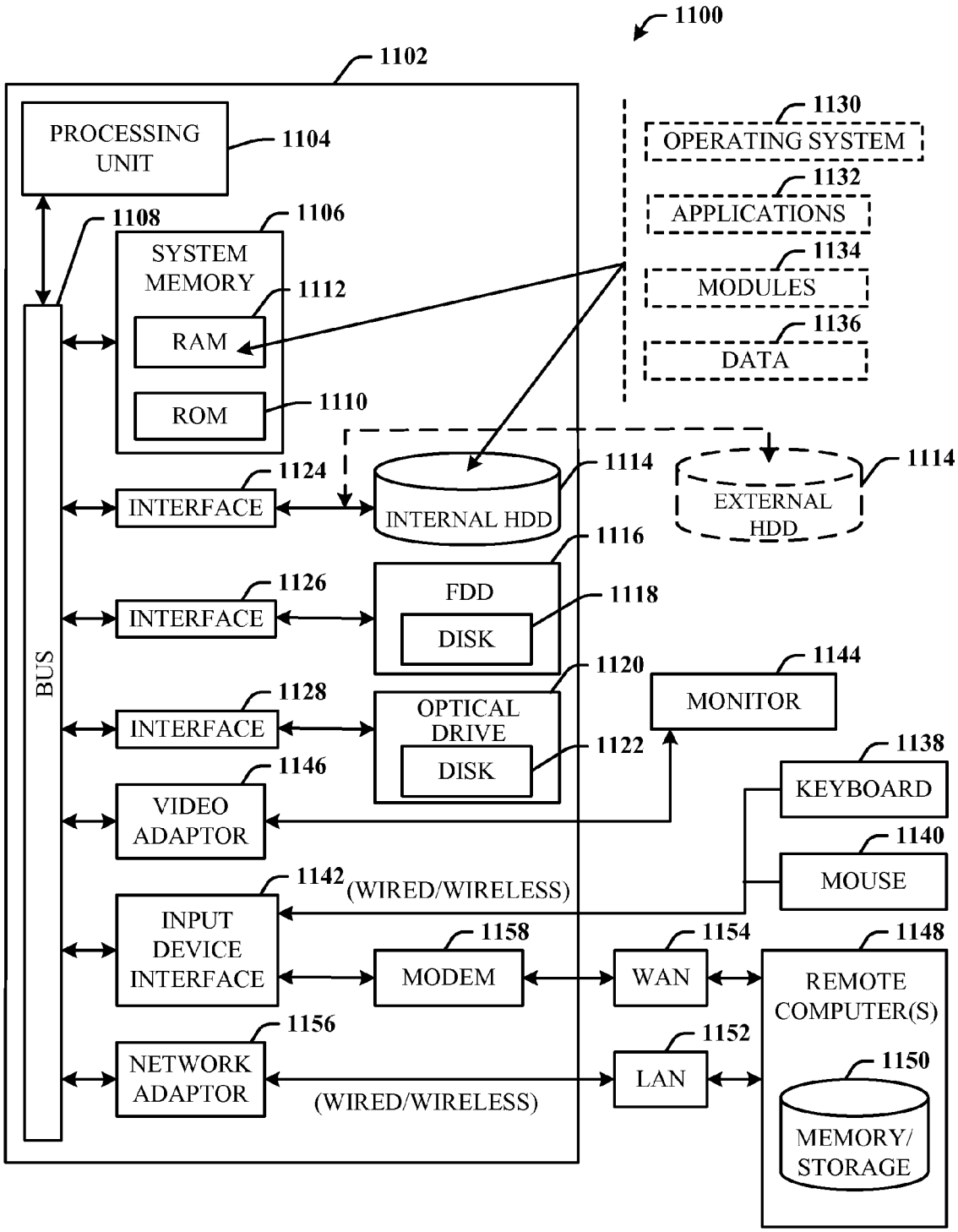
FIG. 11 is an example computing environment that can be employed in connection with various aspects described herein.

Referring now to FIG. 11, there is illustrated a block diagram of a computer operable to aid in performing the analysis of a mobility management message as described above. In order to provide additional context for various aspects of the claimed subject matter, FIG. 11 and the following discussion are intended to provide a brief, general description of a suitable computing environment 1100 in which the various aspects described herein can be implemented. While the description above is in the general context of computer-executable instructions that may run on one or more computers, those skilled in the art will recognize that the claimed subject matter also can be implemented in combination with other program modules and/or as a combination of hardware and software.

Generally, program modules include routines, programs, components, data structures, etc., that perform particular tasks or implement particular abstract data types. Moreover, those skilled in the art will appreciate that the inventive methods can be practiced with other computer system configurations, including single-processor or multiprocessor computer systems, minicomputers, mainframe computers, as well as personal computers, hand-held computing devices, microprocessor-based or programmable consumer electronics, and the like, each of which can be operatively coupled to one or more associated devices.

The illustrated aspects of the claimed subject matter may also be practiced in distributed computing environments where certain tasks are performed by remote processing devices that are linked through a communications network. In a distributed computing environment, program modules can be located in both local and remote memory storage devices.

A computer typically includes a variety of computer-readable media. Computer-readable media can be any available media that can be accessed by the computer and includes both volatile and non-volatile media, removable and non-removable media. By way of example, and not limitation, computer-readable media can comprise computer storage media and communication media. Computer storage media includes both volatile and non-volatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital video disk (DVD) or other optical disk storage, magnetic cassettes, magnetic tape, magnetic disk storage or other magnetic storage devices, or any other medium which can be used to store the desired information and which can be accessed by the computer.

Communication media typically embodies computer-readable instructions, data structures, program modules or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

With reference again to FIG. 11, the exemplary environment 1100 for implementing various aspects includes a computer 1102, the computer 1102 including a processing unit 1104, a system memory 1106 and a system bus 1108. The system bus 1108 couples system components including, but not limited to, the system memory 1106 to the processing unit 1104. The processing unit 1104 can be any of various commercially available processors. Dual microprocessors and other multi-processor architectures may also be employed as the processing unit 1104.

The system bus 1108 can be any of several types of bus structure that may further interconnect to a memory bus (with or without a memory controller), a peripheral bus, and a local bus using any of a variety of commercially available bus architectures. The system memory 1106 includes read-only memory (ROM) 1110 and random access memory (RAM) 1112. A basic input/output system (BIOS) is stored in a non-volatile memory 1110 such as ROM, EPROM, EEPROM, which BIOS contains the basic routines that help to transfer information between elements within the computer 1102, such as during start-up. The RAM 1112 can also include a high-speed RAM such as static RAM for caching data.

The computer 1102 further includes an internal hard disk drive (HDD) 1114 (e.g., EIDE, SATA), which internal hard disk drive 1114 may also be configured for external use in a suitable chassis (not shown), a magnetic floppy disk drive (FDD) 1116, (e.g., to read from or write to a removable diskette 1118) and an optical disk drive 1120, (e.g., reading a CD-ROM disk 1122 or, to read from or write to other high capacity optical media such as the DVD). The hard disk drive 1114, magnetic disk drive 1116 and optical disk drive 1120 can be connected to the system bus 1108 by a hard disk drive interface 1124, a magnetic disk drive interface 1126 and an optical drive interface 1128, respectively. The interface 1124 for external drive implementations includes at least one or both of Universal Serial Bus (USB) and IEEE 1394 interface technologies. Other external drive connection technologies are within contemplation of the subject innovation.

The drives and their associated computer-readable media provide nonvolatile storage of data, data structures, computer-executable instructions, and so forth. For the computer 1102, the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, may also be used in the exemplary operating environment, and further, that any such media may contain computer-executable instructions for performing the methods of the disclosed innovation.

A number of program modules can be stored in the drives and RAM 1112, including an operating system 1130, one or more application programs 1132, other program modules 1134 and program data 1136. All or portions of the operating system, applications, modules, and/or data can also be cached in the RAM 1112. It is to be appreciated that the innovation can be implemented with various commercially available operating systems or combinations of operating systems.

A user can enter commands and information into the computer 1102 through one or more wired/wireless input devices, e.g., a keyboard 1138 and a pointing device, such as a mouse 1140. Other input devices (not shown) may include a microphone, an IR remote control, a joystick, a game pad, a stylus pen, touch screen, or the like. These and other input devices are often connected to the processing unit 1104 through an input device interface 1142 that is coupled to the system bus 1108, but can be connected by other interfaces, such as a parallel port, an IEEE 1394 serial port, a game port, a USB port, an IR interface, etc.

A monitor 1144 or other type of display device is also connected to the system bus 1108 via an interface, such as a video adapter 1146. In addition to the monitor 1144, a computer typically includes other peripheral output devices (not shown), such as speakers, printers, etc.

The computer 1102 may operate in a networked environment using logical connections via wired and/or wireless communications to one or more remote computers, such as a remote computer(s) 1148. The remote computer(s) 1148 can be a workstation, a server computer, a router, a personal computer, portable computer, microprocessor-based entertainment appliance, a peer device or other common network node, and typically includes many or all of the elements described relative to the computer 1102, although, for purposes of brevity, only a memory/storage device 1150 is illustrated. The logical connections depicted include wired/wireless connectivity to a local area network (LAN) 1152 and/or larger networks, e.g., a wide area network (WAN) 1154. Such LAN and WAN networking environments are commonplace in offices and companies, and facilitate enterprise-wide computer networks, such as intranets, all of which may connect to a global communications network, e.g., the Internet.

When used in a LAN networking environment, the computer 1102 is connected to the local network 1152 through a wired and/or wireless communication network interface or adapter 1156. The adaptor 1156 may facilitate wired or wireless communication to the LAN 1152, which may also include a wireless access point disposed thereon for communicating with the wireless adaptor 1156.

When used in a WAN networking environment, the computer 1102 can include a modem 1158, or is connected to a communications server on the WAN 1154, or has other means for establishing communications over the WAN 1154, such as by way of the Internet. The modem 1158, which can be internal or external and a wired or wireless device, is connected to the system bus 1108 via the serial port interface 1142. In a networked environment, program modules depicted relative to the computer 1102, or portions thereof, can be stored in the remote memory/storage device 1150. It will be appreciated that the network connections shown are exemplary and other means of establishing a communications link between the computers can be used.

The computer 1102 is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This includes at least WiFi and Bluetooth™ wireless technologies. Thus, the communication can be a predefined structure as with a conventional network or simply an ad hoc communication between at least two devices.

WiFi, or Wireless Fidelity, allows connection to the Internet from a couch at home, a bed in a hotel room, or a conference room at work, without wires. WiFi is a wireless technology similar to that used in a cell phone that enables such devices, e.g., computers, to send and receive data indoors and out; anywhere within the range of a base station. WiFi networks use radio technologies called IEEE 802.11 (a, b, g, etc.) to provide secure, reliable, fast wireless connectivity. A WiFi network can be used to connect computers to each other, to the Internet, and to wired networks (which use IEEE 802.3 or Ethernet). WiFi networks operate in the unlicensed 2.4 and 5 GHz radio bands, at an 11 Mbps (802.11a) or 54 Mbps (802.11b) data rate, for example, or with products that contain both bands (dual band), so the networks can provide real-world performance similar to the basic 10BaseT wired Ethernet networks used in many offices.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A wireless communication apparatus, comprising:

a generator component configured to generate an acoustic burst that is out of phase with radio frequency interference at a hearing aid resulting at least in part from a transmitter associated with the wireless communication apparatus;

a timing component configured to monitor transmission time slots associated with transmission of speech data by the wireless communication apparatus to determine a timing of the acoustic burst; and a caching component configured to selectively cache the speech data for a period of time prior to the transmission of the speech data based on a result generated by the timing component.

2. The wireless communication apparatus of claim 1, wherein the timing of the acoustic burst is controlled by a timing parameter defined in a profile associated with a type of the hearing aid.

3. The wireless communication apparatus of claim 2, further comprising:

an interface generator component configured to output a training instruction by way of a graphical display; and a user input receiver component configured to receive an external response to the training instruction indicative of the radio frequency interference detected at the hearing aid, the external response being employed to set the timing parameter defined in the profile.

4. The wireless communication apparatus of claim 2, further comprising:

a data store containing a set of profiles associated with respective hearing aid types and containing respective sets of timing parameters for generation of the acoustic burst; and a profile selector component configured to select the profile from the set of profiles.

5. The wireless communication apparatus of claim 4, wherein the profile selector component is further configured to select the profile based on the type of the hearing aid.

6. The wireless communication apparatus of 4, wherein the profile selector component is further configured to select the profile based on an identification of a user of the wireless communication apparatus.

7. The wireless communication apparatus of claim 4, further comprising a sensor component configured to sense an alteration in orientation of the wireless communication apparatus, wherein the profile selector component is further configured to automatically select the profile based at least in part upon the sensed alteration in the orientation.

8. The system of claim 2, further comprising a monitoring component configured to monitor an operating parameter of the transmitter, wherein the timing of the acoustic burst is based upon the operating parameter and the profile.

9. A method for reducing audible radio frequency interference, comprising:

generating an acoustic burst that is out of phase with radio frequency interference at a hearing aid as a result of a transmitter;

monitoring transmission slots of the transmitter to determine a timing of the acoustic burst; and selectively caching speech signals for a period of time before transmission of the speech signals by the transmitter based on a result of the monitoring.

10. The method of claim 9, the generating further comprising selecting the timing of the acoustic burst according to a defined timing parameter in a timing profile associated with a type of the hearing aid.

11. The method of claim 10, further comprising:

maintaining a plurality of timing profiles associated with respective hearing aid types, the plurality of timing profiles defining timing parameters for generating the acoustic burst; and selecting the timing profile from the plurality of timing profiles for use in generating the acoustic burst.

12. The method of claim 11, wherein the selecting includes:

determining an identity of a user of the transmitter; and selecting the timing profile based at least in part on the identity of the user.

13. The method of claim 11, wherein the selecting includes:

determining a type of the hearing aid; and selecting the timing profile based at least in part on the type of the hearing aid.

14. The method of claim 10, further comprising:

adjusting the timing parameter defined by the timing profile in accordance with received user input to form an adjusted timing parameter; and saving the adjusted timing parameter to a new timing profile.

15. The method of claim 9, further comprising analyzing an operating parameter associated with a transmitter, wherein the generating the acoustic burst comprises generating the acoustic burst based at least in part upon the operating parameter.

16. A non-transitory computer-readable medium having stored thereon computer-executable instructions that, in response to execution, cause a device to perform operations including:

generating an acoustic burst that is out of phase with radio frequency interference at a hearing aid as a result of a transmitter;

monitoring transmission slots of the transmitter to determine a timing of the acoustic burst; and selectively caching speech signals for a period of time before transmission of the speech signals by the transmitter based on a result of the monitoring.

17. The non-transitory computer-readable medium of claim 16, wherein the generating comprises setting the timing of the acoustic burst according to a timing parameter defined in a stored profile associated with a type of the hearing aid.

18. The non-transitory computer-readable medium of claim 17, the operations further including:

selecting the stored profile based at least in part on a user identity associated with the stored profile.

19. The non-transitory computer-readable medium of claim 17, the operations further including:

receiving input indicating whether the acoustic burst has cancelled the radio frequency interference at the hearing aid; and adjusting the timing parameter based on the input.

20. The non-transitory computer-readable medium of claim 16, the operations further comprising:

analyzing an operating parameter associated with a transmitter; and generating the acoustic burst based on the operating parameter.

* * * * *